US007141728B2

(12) United States Patent
Yoshisue et al.

(10) Patent No.: US 7,141,728 B2
(45) Date of Patent: Nov. 28, 2006

(54) ACTION PART FOR PIANO

(75) Inventors: Kenji Yoshisue, Hamamatsu (JP); Kiyoshi Abe, Hamamatsu (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 3 days.

(21) Appl. No.: 10/714,912

(22) Filed: Nov. 18, 2003

(65) Prior Publication Data

US 2004/0168562 A1 Sep. 2, 2004

(30) Foreign Application Priority Data

Feb. 28, 2003 (JP) ..... 2003-054708
Jul. 14, 2003 (JP) ..... 2003-196633

(51) Int. Cl.
*G10C 3/18* (2006.01)

(52) U.S. Cl. ..... 84/236

(58) Field of Classification Search ..... 84/236–255
See application file for complete search history.

(56) References Cited

U.S. PATENT DOCUMENTS 3,240,095 A * 3/1966 Steinway ..... 84/251
3,583,271 A * 6/1971 Corwin et al. ..... 84/236
3,878,752 A * 4/1975 Yamada ..... 84/254
4,770,929 A * 9/1988 Nobumasa et al. ..... 442/278
5,945,617 A * 8/1999 Niitsuma ..... 84/423 R

FOREIGN PATENT DOCUMENTS

JP 62-146194 9/1987

* cited by examiner

*Primary Examiner*—Kimberly Lockett
(74) *Attorney, Agent, or Firm*—Crowell & Moring LLP

(57) ABSTRACT

There is provided an action part for a piano, which has higher rigidity than that of an action part made only of a synthetic resin, while maintaining advantageous effects as provided by the use of the synthetic resin, thereby making it possible to obtain the sound volume with a smaller key depression energy, and enhance responsiveness of the action. The action part is pivotally moved along with depression of key to thereby transmit key depression energy generated by depression of the key, to a hammer. The action part is formed by a molded article of a thermoplastic resin that is molded by a long fiber process and contains long fibers for reinforcement.

15 Claims, 8 Drawing Sheets

ACTION PART FOR PIANO

BACKGROUND OF THE INVENTION

1. Field of the Invention

The present invention relates to an action part for a piano, which is pivotally moved along with depression of a key to thereby transmit key depression energy generated by depression of the key, to a hammer.

2. Description of the Related Art

In general, a wippen, which is one of action parts of a grand piano, is made of wood, and pivoted at a rear end thereof for pivotal motion thereabout (hereinafter, a forward side as viewed from the player is referred to as "the rear"). The wippen is placed on a rear part of a key. When pushed up by the key depressed, the wippen is pivotally moved upward, and causes other action parts, such as a jack, to be moved in an interlocked manner, thereby causing the hammer to pivotally move upward for striking a string stretched thereabove. After that, the wippen is pivotally moved downward by gravity, and brought into abutment with the rear part of the key, whereby the key is made ready for next depression. As described above, the wippen is one of essential action parts for transmitting key depression energy generated by depressing the key to the hammer. Further, an action is placed on the key via the wippen, as part of the action, so that the weight of the action is closely related to the touch weight of the key. The touch weight of the key is adjusted by a balance between a weight attached to a front portion of the key and the weight of the action.

An example of the wippen described above has been conventionally proposed e.g. in Japanese Laid-Open Utility Model Publication (Kokai) No. 62-146194. This wippen is made of a metal or a synthetic resin, or has a weight attached thereto, so as to increase the weight thereof. After once pivotally moved upward, the wippen increased in weight due to the above construction descends at an increased speed, whereby it is promptly brought into abutment with the key.

As described above, the wippen plays the role of a transmitter of key depression energy. In general, the wippen is made of wood, because wood is light in weight and high in rigidity, and hence is suitable for transmitting key depression energy. However, when compared with a synthetic resin, wood is inferior in machining accuracy, which makes troublesome the adjusting operations required in the manufacturing of actions. Further, wood has a larger dimensional change due to drying and wetting, which makes the wippen made of wood liable to be displaced in positional relationship with the other action parts. This makes it difficult to maintain normal motion of the action.

On the other hand, the wippen made of a synthetic resin does not suffer from the above inconveniences caused by the use of the wippen made of wood, but since the rigidity of synthetic resin is lower than that of wood, the pivotal motion of the hammer is reduced in speed. As a result, to obtain the same sound volume, a larger key depression energy is necessitated. Further, since synthetic resin has a larger specific gravity than that of wood, the motion of the wippen becomes slow, which lowers responsiveness of the action, resulting in the delayed timing for hammering the string. Further, the larger specific gravity of synthetic resin increase the weight of the whole action including the wippen, and hence to obtain the same touch weight as that of the wippen made of wood, it is necessary to increase the amount of the above-mentioned weight attached to the key.

The wippen made of metal does not suffer from the inconveniences causes by the use of the wippen made of wood, similarly to that made of synthetic resin, but since metal has a still larger specific gravity than that of synthetic resin, delay of the string-hammering timing and increase in the weight for the key become significant. This is also true in the case of the weight being attached to the wippen.

SUMMARY OF THE INVENTION

It is an object of the invention to provide an action part for a piano, which has higher rigidity than that of an action part made only of a synthetic resin, while maintaining advantageous effects as provided by the use of the synthetic resin, thereby making it possible to obtain the sound volume with a smaller key depression energy, and enhance responsiveness of the action.

To attain the above object, the present invention provides an action part for a piano, which is pivotally moved along with depression of a key to thereby transmit key depression energy generated by depression of the key, to a hammer, wherein the action part is formed by a thermoplastic resin molded article that is molded by a long fiber process and contains long fibers for reinforcement.

This action part according to the present invention is formed by a thermoplastic resin molded article that is molded by a long fiber process and contains long fibers for reinforcement. Now, the long fiber process is for obtaining a molded article by injection molding of a pellet that is coated with a thermoplastic resin and contains a fibrous reinforcing material containing fibers having the same length as the length of the pellet. According to the long fiber process, a relatively long fibrous reinforcing material having a fiber length of e.g. 0.5 mm or more is caused to be contained in the molded article. Therefore, the action part according to the present invention contains relatively long reinforcing long fibers, and hence can have a very high rigidity compared with an action part made only of a synthetic resin. This makes it possible to reduce transmission loss of key depression energy caused by deformation of the action part occurring when the action part is pushed up by the key, so that the rotational speed of the hammer can be increased. As a result, it becomes possible to obtain an equivalent level of sound volume with a smaller key depression energy. Further, since the action part is formed by a thermoplastic resin, it possible to obtain advantageous effects of a synthetic resin that ensures high machining accuracy and dimensional stability.

Preferably, the long fibers are carbon fibers.

When dust is attached to a movable portion of the action part, the motion of the action pat becomes slow, which can cause lowered responsiveness of the action part. Further, in general, carbon fibers have a higher electric conductivity than other reinforcing long fibers, such as glass fibers. Therefore, according to this preferred embodiment, by using carbon fibers as the reinforcing long fibers contained in the thermoplastic resin forming the action part, it is possible to increase the electric conductivity of the action part to thereby lower the electrostatic changeability thereof. As a result, attachment of dust to the action part can be suppressed, which makes it possible to maintain excellent motion of the action part and excellent responsiveness of the action. Further, by suppressing attachment of dust to the action part, it is possible not only to maintain an excellent appearance of the action but also to prevent the hands and clothes of the worker from being stained e.g. during operations for adjusting the action.

Preferably, the action part includes a lightening portion for reducing a weight of the action part.

According to this preferred embodiment, since the action part is provided with the lightening portion, the weight of the action part can be reduced. This makes it possible to make swift the motion of the action part, thereby making it possible to enhance the responsiveness of the action. Further, the total weight of the action can be reduced along with the reduction of the weight of the action part, which allows reduction of a weight attached to the key. Further, in an action part made only of a synthetic, reduction of weight thereof is limited since it is necessary to secure rigidity required for transmitting sufficient key depression energy. In contrast, the action part according to the present invention has a very high rigidity due to the above-mentioned long fibers. Therefore, due to an adequate margin of rigidity, even if the weight of the action part is reduced, the degree of influence of the reduction of weight on the rigidity is very small. This makes it possible to actively decrease the weight of the action part, whereby it becomes possible to maximize reduction of the weight of the action part by provision of the lightening portion. Thus, it is possible to reduce the weight of the action part and at the same time secure the high rigidity of the action part.

Preferably, the thermoplastic resin is an ABS resin.

In general, an action part often has other parts rigidly fixed thereto. On the other hand, the ABS resin is high in adhesiveness among the thermoplastic resins. Therefore, according to this preferred embodiment, by using the ABS resin as the thermoplastic resin for forming the action part, the other parts can be easily bonded to the action part using an adhesive, which increases the ease of assembly of the action.

Further, in general, when a thermoplastic resin containing a reinforcing material, such as carbon fibers, is molded by injection molding, if the melt flow rate thereof is large, an inflow rate of the thermoplastic resin flowing into a mold is high, which makes the reinforcing material liable to be oriented in a specific direction in a molded article. This may cause anisotropy of the rigidity of the molded article. In contrast, the ABS resin is a thermoplastic resin containing a rubbery polymer, whose melt flow rate is small. Therefore, according to this preferred embodiment, by forming the action part by the ABS resin, as described above, anisotropy of the rigidity of the action can be suppressed, and hence the high rigidity of the action part can be stably obtained. Furthermore, impact strength of the action part can be enhanced by ductility of the ABS resin.

Preferably, the action part is a wippen pivotally moved by being pushed up by the key depressed.

The wippen is one of essential action parts which is directly pushed up by the key for pivotal motion to transmit the key depression energy to the hammer via other action parts. According to this preferred embodiment in which the present invention is applied to the wippen, the rigidity of the wippen is increased to a very large degree, whereby it is possible to suppress deformation of the action part pushed up by the key. As a result, the transmission efficiency in transmitting the key depression energy can be further enhanced. Thus, it is possible to obtain the above described advantageous effects of the invention more effectively. Further, the wippen operates in a manner interlocked with other action parts to force the hammer into a pivotal motion of striking a string, and therefore when the above lightening portion is formed in the wippen, the operation of the wippen can be made swift due to the reduced weight thereof.

Preferably, the wippen comprises a main body that extends in a front-rear direction, and includes a front part, a rear part pivotally supported about a horizontal axis, and a central part located between the front part and the rear part, and having a vertical length larger than those of the front part and the rear part, a heel section for being pushed up by the key, the heel section protruding downward from the central part of the main body, and being continuous with the front part and the rear part of the main body via respective transition portions having obliquely linear or curved lower surfaces, and a recess formed in at least one of the main body and the heel section, for reducing a weight of the at least one of the main body and the heel section.

According to this preferred embodiment, by being pushed up at the heel section by the key, the wippen extending in a front-rear direction is pivotally moved about the horizontal axis extending through the rear end thereof. Therefore, bending load generated by a thrusting force of the key directly acts on the heel section and the central part of the main body continuous with the heel section, which makes, particularly, the heel section and the central part liable to be deformed. According to the present embodiment, however, the central part of the main body has a vertical length larger than those of the front part and the rear part, and the heel section is continuous with the front part and the rear part of the main body via transition portions having an obliquely linear or curved lower surface, such that the height (vertical length) of the wippen is progressively changed at boundary portions between the heel section and the main body. This increases the bending rigidity of the wippen and a total rigidity of the central part and the heel section, and hence the deformation of the wippen caused when pushed up by the key can be suppressed. Therefore, it is possible to further enhance the transmission efficiency in transmitting the key depression energy. Moreover, since the height of the wippen is progressively changed at the boundary portions between the heel section and the main body, as described above, it is possible to prevent stress concentration at the boundary portions when a thrusting force of the key acts thereon, and adverse effects of the stress concentration on the wippen.

Furthermore, since the recess (lightening portion) is formed in the main body and/or the heel section, the weight of the wippen can be decreased, whereby the motion of the wippen can be made swift. Further, since the wippen according to the present embodiment has a very high rigidity, it is possible to maximize the reduction of the weight of the wippen by provision of the recess, similarly to the lightening portion described hereinabove.

Preferably, at least one of the front part and the rear part of the main body is continuous with the central part of the main body via a transition portion having an obliquely linear or curved upper surface.

According to this preferred embodiment, the front part and/or the rear part of the main body are/is continuous with the central part of the main body via the transition portion(s) having the obliquely linear or curved upper surface, and the height (vertical length) of the wippen is progressively changed at the boundary portion(s) between the front part and/or the rear part, and the central part. This makes it possible to maintain the rigidity of the boundary portion(s) as high as possible, and prevent stress concentration at the boundary portion(s).

Preferably, the heel section includes a increased-thickness reinforcing portion for reinforcing the heel section.

According to this preferred embodiment, since the heel section pushed up by the key is reinforced by the increased-thickness reinforcing portion, it is possible to reinforce the rigidity, particularly, of the heel section liable to deformation.

Preferably, the wippen comprises a main body that extends in a front-rear direction, and is pivotally supported about a horizontal axis at a rear end thereof, a heel section that protrudes downward from the main body, and includes a front surface and a rear surface continuous with the main body, at least one of the front surface and the rear surface being formed to extend obliquely linearly or in a curved manner, and a recess that is formed in at least one of the main body and the heel section, for reducing a weight of the at least one of the main body and the heel section.

According to this preferred embodiment, the front surface and/or the rear surface of the heel section continuous with the main body of the wippen are/is formed to extend obliquely linearly or in a curved manner, and at the boundary portion(s) between the heel section and the main body, the height of the wippen is progressively reduced from the heel section along the front-rear direction, causing progressive reduction in rigidity. Accordingly, the rigidity of the boundary portion(s) can be increased compared with the conventional wippen in which the height thereof is sharply reduced. Further, since the height of the wippen is progressively reduced at the boundary portion(s) between the heel section and the main body, as described above, it is possible to prevent stress concentration from occurring at the boundary portion(s) when a thrusting force of the key acts thereon, and inconveniences from being caused by the stress concentration. Further, since the recess is formed in the main body and/or the heel section, the weight of the wippen can be reduced thereby.

Preferably, the recess is continuously formed in the main body and the heel section.

According to this preferred embodiment, since the recess is formed over a wide area of the wippen, it is possible to sufficiently reduce the weight of the wippen.

The above and other objects, features, and advantages of the invention will become more apparent from the following detailed description taken in conjunction with the accompanying drawings.

DETAILED DESCRIPTION OF THE PREFERRED EMBODIMENTS

Figure 3:
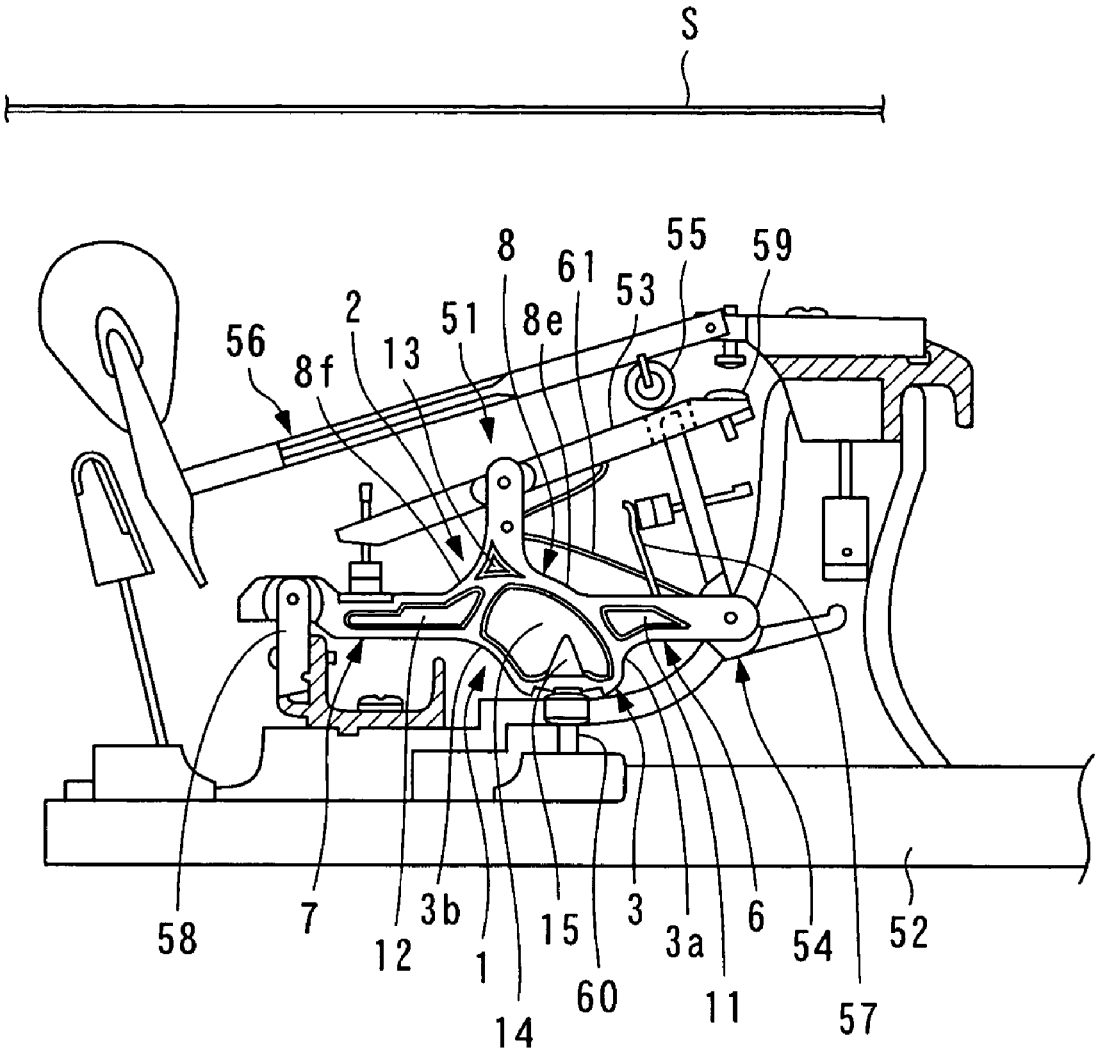
FIG. 3 is a side view of a keyboard device including an action to which is applied the FIG. 1 wippen.

The invention will now be described in detail with reference to the drawings showing preferred embodiments thereof. Referring first to FIG. 3, there is shown an action 51 of a grand piano, including a wippen 1 (action part) according to a first embodiment of the invention, in a key-off state of a key 52. The action 51 is comprised of the wippen 1 extending in the front-rear direction (left-right direction, as viewed in FIG. 3), and placed on a rear portion (left portion as viewed in FIG. 3) of the key 52 via a capstan screw 60, and a repetition lever 53 and a jack 54 which are pivotally mounted to the wippen 1. The wippen 1 is supported by a wippen flange 58, such that it is movable about a horizontal axis extending through a rear end thereof pivoted to the wippen flange 58. A hammer 56 is placed on a top of a front portion of the repetition lever 53 via a shank roller 55. Further, a weight, not shown, which is attached to the key, for adjusting a touch weight, is mounted to a front end of the key 52.

When the key 52 is depressed from the key-off state, the wippen 1 is pushed up, whereby the repetition lever 53 and the jack 54 are pivotally moved upward together with the wippen 1. Then, the jack 54 pivotally moved upward pushes up the hammer 56 via the shank roller 55, whereby the hammer 56 strikes a string S.

The wippen 1 is molded by a long fiber process. In the long fiber process, the wippen 1 is obtained by molding a pellet, described below, by injection molding. The pellet is molded by coating roving of carbon fibers oriented by application of a predetermined tensile force thereto, e.g. with an ABS resin, which is a thermoplastic resin containing a rubbery polymer, extruded from an extruder. This makes it possible to cause the carbon fibers to be contained in the pellet without braking the roving of carbon fibers when the pellet is molded, and hence carbon fibers having the same length as that of the pellet are contained in the pellet. In the present embodiment, the length of the pellet is set to 5 to 15 mm, so that carbon fibers having a length of 0.5 to 2 mm are contained in the wippen 1 formed by injection molding using the pellet. It should be noted that a melt flow rate of the above rubbery polymer is set to a relatively small value, e.g. in a range of 0.1 to 50 g/10 minutes under testing conditions of 230° C. and a load of 2.16 kg.

Figure 1:
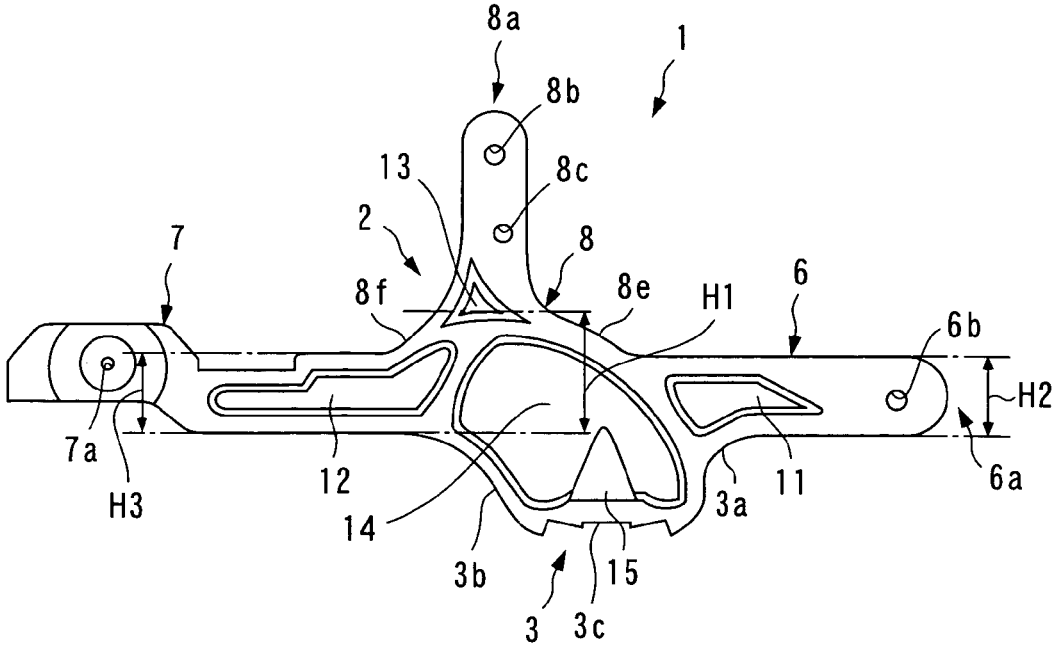
FIG. 1 is a side view of a wippen according to a first embodiment of the invention.

The wippen 1 has a shape in side view shown in FIG. 1 and includes a main body 2 extending in the front-rear direction, and a heel section 3 continuous with a lower side of the main body 2 for being pushed up by the key 52. The wippen 1 has a thickness in the left-right direction set to a predetermined size (e.g. 9.6 mm) at portions thereof except for recesses, referred to hereinafter. Further, the total weight of the wippen 1 is approximately 10 g.

The main body 2 is divided into a front part 6, a central part 8, and a rear part 7 in the mentioned order from the front side. The front part 6 and the rear part 7 are basically rectangular in cross section. The front part 6 has a predetermined height H2 (vertical length), and extends in the front-rear direction. The rear part 7 extends in the front-rear direction and has a predetermined height H3 (vertical length) approximately equal to the predetermined height H2, with an intermediate portion thereof formed to be a step lower than the predetermined height H3. A portion rearward of the intermediate portion shortly extends obliquely upward, and continuously forms a horizontally extending rear end. A height H1 (vertical length) of the central part 8 is set to be larger than the heights H2 and H3 of the front part 6 and the rear part 7. Further, a portion of the central part 8, toward the rear end thereof, has a lever-mounting portion 8*a* integrally formed therewith in a manner protruding upward. Furthermore, an upper portion of the central part 8 and upper portions of the front part 6 and the rear part 7 are continuous with each other via respective transition portions 8*e* and 8*f*. The upper surface of the front-side transition portion 8*e* extends obliquely upward from the front part 6 to the central part 8 in an outwardly slightly curved manner. On the other hand, the upper surface of the rear-side transition portion 8*f* extends obliquely upward from the rear part 7 to the central part 8 in an inwardly slightly curved manner.

The heel section 3 protrudes downward from the central part 8. A lower portion of the heel section 3 and lower portions of the front part 6 and the rear part 7 are continuous with each other via transition portions 3*a* and 3*b*, respectively. The lower surface of the front-side transition portion 3*a* extends obliquely downward from the front part 6 to the heel section 3 in an inwardly slightly curved manner. On the other hand, the lower surface of the rear-side transition portion 3*b* extends obliquely downward from the rear part 7 to the heel section 3 in an inwardly slightly but more gently curved manner than the front-side transition portion 3*a*. Further, a central portion of the bottom surface of the heel section 3 is formed with a capstan screw-abutting portion 3*c*, which is slightly recessed, and this portion is in abutment with the capstan screw 60.

The wippen 1 has left and right sides thereof formed with a plurality of recesses (lightening portions) for reducing the weight of the wippen 1, more specifically, front recesses 11, rear recesses 12, upper recesses 13, and central recesses 14 (only one of which is shown), at corresponding locations. The recesses are integrally formed with the wippen 1 when the wippen 1 is molded by injection molding. Further, the depths of the recesses 11, 12, and 14 except for the upper recesses 13 are set to the same value, more specifically, to a lower limit value (e.g. 1 mm) of thickness which is large enough to mold the wippen 1.

Each of the front recess 11 is formed such that it extends in the front-rear direction from a central portion of the front part 6 in the front-rear direction to the front-side transition portion 3*a*, leaving peripheral portions having a predetermine width.

Each of the rear recesses 12 is formed such that it extends in the front-rear direction from a portion of the rear part 7 immediately before the rear end thereof to the rear-side transition portion 8*f*, leaving peripheral portions having a predetermine width.

Each of the upper recesses 13 is formed in a lower end of the lever-mounting portion 8*a*. The upper recess 13 has a generally rectangular shape which has a side extending along the outer surface of the lever-mounting portion 8*a*, and is spaced from the rear recess 12 and the central recess 14.

Each of the central recesses 14 is formed such that is extends continuously from the central part 8 into the whole heel section 3, leaving outer peripheral portions having a predetermine width from the respective outer surfaces of the heel section 3, and the transition portions 3*a*, 3*b*, 8*e*.

In a lower part of the central recess 14 at a location exactly above the capstan screw-abutting portion 3*c*, there is formed an increased-thickness reinforcing portion 15 for reinforcing the rigidity of the heel section 3. The increased-thickness reinforcing portion 15 is integrally formed with the wippen 1 when the wippen 1 is molded by injection molding. The increased-thickness reinforcing portion 15 has a generally conical shape, and protrudes laterally in the left and right directions from bottom surfaces of the central recesses with an apex thereof being positioned upside such that most protruded portions thereof are flush with opposite side surfaces of the heel section 3, respectively.

Figure 2:
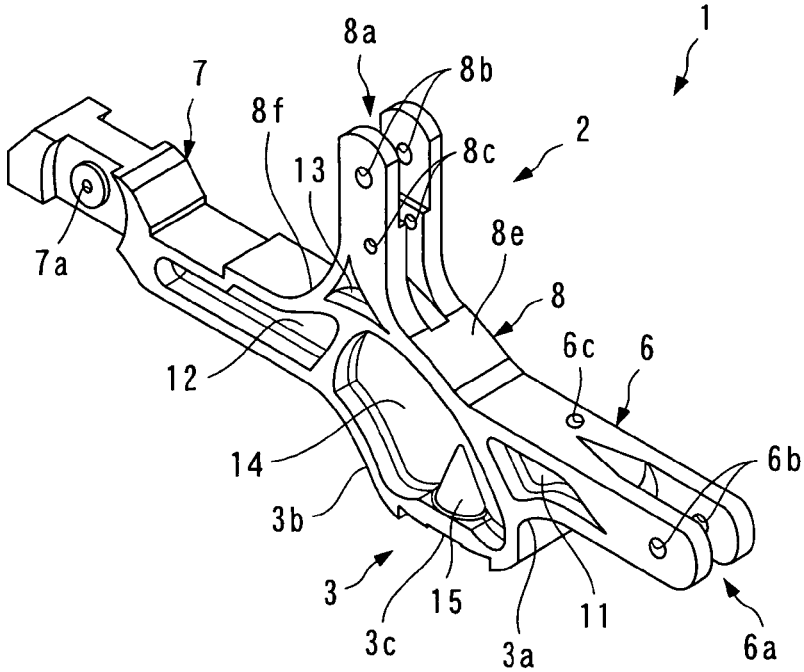
FIG. 2 is a perspective view of the FIG. 1 wippen.

It should be noted that similarly to the conventional wippen, the front part 6 has a front-side portion thereof bifurcated into left and right portions which form a jack-mounting portion 6*a*, as shown in FIG. 2. The bifurcated (left and right) portions of the jack-mounting portion 6*a* are formed with jack-mounting holes 6*b* for mounting the jack 54, which extend therethrough in the left-right direction. To the jack-mounting holes 6*b* are bonded respective pieces of bushing cloth, not shown, for passing a pin, not shown, for supporting the jack 54, by using an adhesive. Further, the front part 6 has an upper surface formed with a spoon-mounting hole 6*c* vertically extending therethrough at a location backward of the jack-mounting portion 6*a*. A spoon 57 (see FIG. 3) is press-fitted in the spoon-mounting hole 6*c*.

The lever-mounting portion 8*a* is bifurcated into left and right portions. Each of the bifurcated (left and right) portions has a lever-mounting hole 8*b* for mounting the repetition lever 53, and a spring-mounting hole 8*c* for mounting a repetition spring 61 (see FIG. 3) in an upper end and a central portion thereof, respectively. To the lever-mounting holes 8*b* as well are bonded respective pieces of bushing cloth, not shown, by using an adhesive.

The rear part 7 has a rear end thereof formed with a supported hole 7*a* extending therethrough in the left-right direction. The wippen 1 is pivotally supported by the wippen flange 58 (see FIG. 3) via a center pin passed through the supported hole 7*a*.

As described hereinabove, according to the present embodiment, since the wippen 1 contains relatively long carbon fibers having a length of 0.5 to 2 mm as reinforcing long fibers, it is possible to obtain a very high rigidity. Further, the height H1 of the central part 8 of the main body 2 is set to be larger than the heights H2 and H3 of the front part 6 and the rear part 7, whereby the rigidity of the central part 8 can be enhanced. Furthermore, the heel section 3 and the central part 8 are continuous with the front part 6 and the rear part 7 via the curved transition portions 3*a* and 3*b*, and the curved transition portions 8*e* and 8*f*, respectively, and at boundary portions thereof, the height (vertical dimension) of the wippen 1 is progressively reduced in the front-rear direction, causing progressive reduction in rigidity thereof, whereby high rigidity can be maintained at the boundary portions. Further, the rigidity of the heel section 3 is increased by the increased-thickness reinforcing portion 15. From the above construction, the wippen 1 has a very high rigidity, which enable the rotational speed of the hammer 56 to be increased by reducing transmission loss of key depression energy, and hence it is possible to obtain an equivalent level of sound volume with a smaller key depression energy.

Since carbon fibers are contained as reinforcing long fibers, it is possible to suppress attachment of dust to the wippen 1, thereby making it possible to maintain excellent motion of the wippen 1 and excellent responsiveness of the action 51. Further, by suppressing attachment of dust to the wippen 1, it is possible not only to maintain excellent appearance of the action 51 but also to prevent the hands and clothes of a worker from being stained e.g. during operations for adjusting the action 51. Further, since the wippen 1 is formed by a thermoplastic resin, it possible to obtain advantageous effects of a synthetic resin that ensures high machining accuracy and dimensional stability. Furthermore, since the wippen 1 is formed by an ABS resin having a high adhesiveness, the pieces of bushing cloth can be easily bonded to the jack-mounting holes 6*b* and the lever-mounting holes 8*b* by using an adhesive. This increases the ease of assembly of the action 51.

Further, the height of the wippen 1 is gently changed at the boundary portions between the heel section 3 and the main body 2, between the front part 6 and the central part 8, and between the rear part 7 and the central part 8, by the transition portions 3*a*, 3*b*, 8*e* and 8*f*, so that it is possible to prevent stress concentration from occurring at the boundary portions when a thrusting force of the key 52 acts on the wippen 1, and adverse effects of the stress concentration from being caused on the wippen 1.

Further, as described hereinabove, the recesses 11 to 14 are arranged in the side surfaces of the wippen 1 such that they have maximum allowable areas and maximum allowable depths. By this large reduction of weight of the wippen 1, the motion of the wippen can be made swift. Therefore, it is possible to enhance responsiveness of the action 51 to depression of the key 52, for example, to quicken timing in striking the string S. Further, since the total weight of the action 51 can be reduced along with the reduction of the weight of the wippen 1, it is possible to reduce the weight attached to the key.

Further, the central recess 14, the front recess 11, the rear recess 12, and the upper recess 13 are not continuous but separate from each other, and the boundary portions thereof are formed as thick ribs. This makes it possible to secure rigidities of the boundary portions.

Further, the melt flow rate of the rubbery polymer contained in the ABS resin forming the wippen 1 is relatively small, and hence it is possible to prevent carbon fibers from being oriented in a specific direction in a molded article. This makes it possible to prevent anisotropy of the rigidity of the wippen 1 from being caused, thereby making it possible to stably obtain a high rigidity of the wippen 1. Furthermore, impact strength of the wippen 1 can be enhanced by ductility of the ABS resin.

Figure 4:
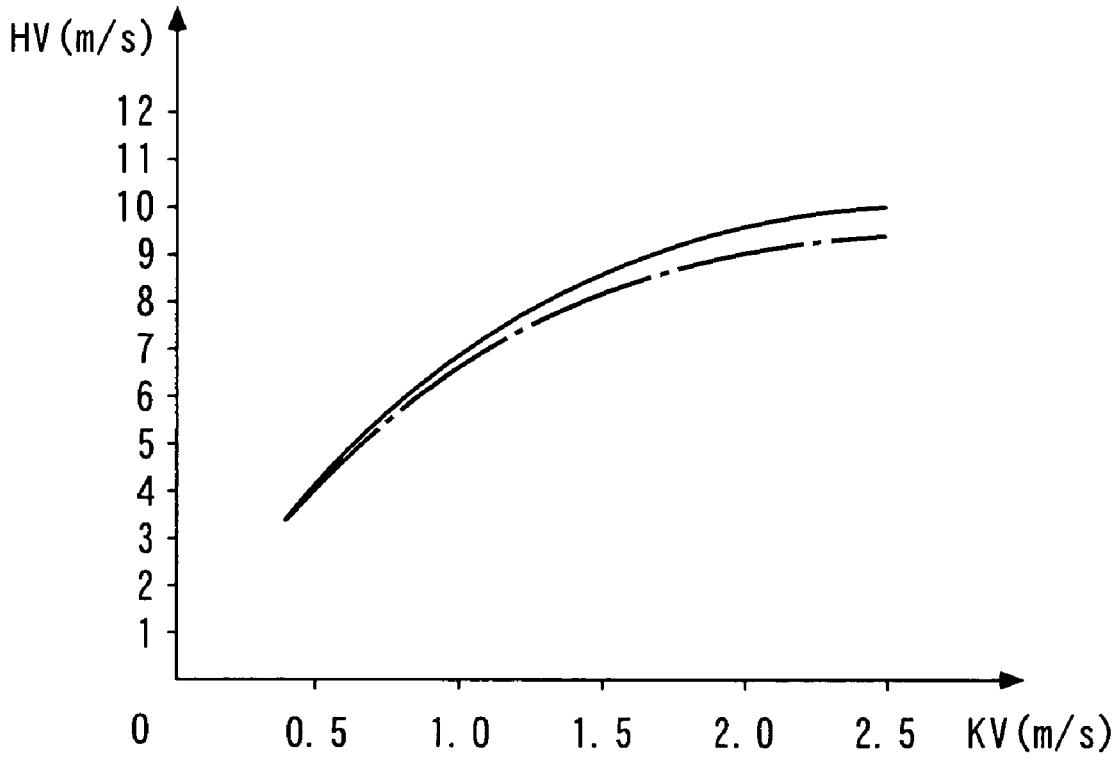
FIG. 4 is a diagram showing the relationship between a key depression speed of the key and the rotational speed of the hammer in a case of the FIG. 1 wippen being employed, and in a case of a wippen made of wood being employed.

FIG. 4 shows the relationship between a key depression speed KV (m/s) of the key 52 and the rotational speed HV (m/s) of the hammer 56 in a case of the wippen 1 having the above constructed being employed, and in a case of a wippen made of wood being employed, by a solid line and a one-dot chain line, respectively. As shown in FIG. 4, the rotational speed HV (m/s) of the hammer 56 with respect to the key depression speed KV is somewhat larger when the wippen 1 is employed than when the wippen made of wood is employed. Due to the enhanced rigidity of the wippen 1 thus realized, it is possible to obtain the wippen 1 having rigidity equal to or larger than that of the wippen made of wood.

In general, the volume of sound generated when a key is strongly struck is larger as the rotational speed of a hammer is higher. Further, the rotational speed of the hammer is increased as the key depression speed, i.e. key depression energy is increased, and when the key depression energy becomes very large, the rotational speed of the hammer reaches a limit to be saturated. From the relationship described above, if a saturation value of the rotational speed of the hammer is low, even if the key is strongly depressed, a piano cannot generate a sufficient level of sound volume, which makes the piano degraded in the capability of musical expression. The saturation value of the rotational speed of the hammer is increased as the rigidity of a wippen is increased. As described above, the wippen 1 according to the present invention can have a higher rigidity than the wippen made of wood, which enables the saturation value of the rotational speed of the hammer to be increased. Therefore, it is possible for the piano using the wippen 1 to realize rich musical expression.

Figure 5:
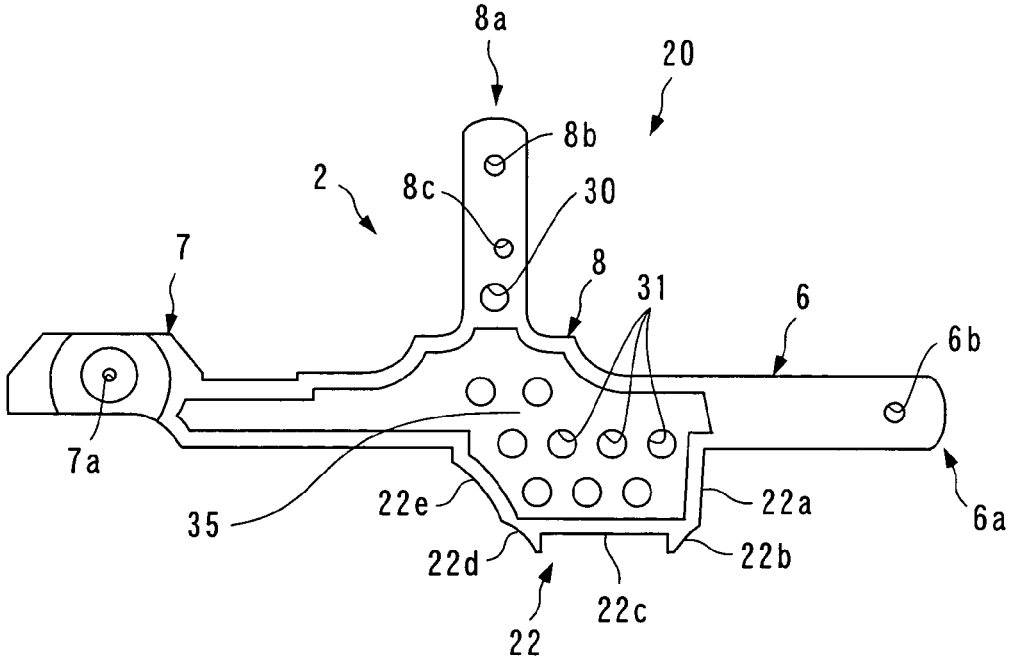
FIG. 5 is a side view of a wippen according to a second embodiment of the invention.
Figure 6:
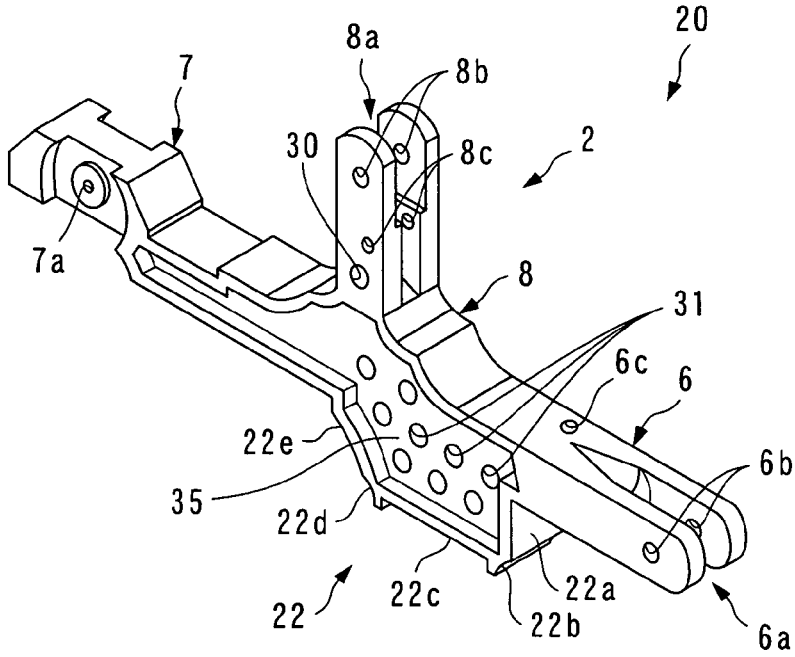
FIG. 6 is a perspective view of the FIG. 5 wippen.

FIG. 5 and FIG. 6 shows a wippen 20 (action part) according to a second embodiment of the invention. In these figures, component elements identical to those of the wippen 1 according to the first embodiment are designated by identical reference numerals. The wippen 20 according to the present embodiment is distinguished from the first embodiment mainly in the shapes of sides thereof, and the construction of each recess 35 (lightening portion) for reducing the weight of the wippen 20.

The upper surface of the wippen 20 has a front-side portion extending obliquely upward and backward from a rear end of the front part 6 in an inwardly slightly curved manner, and then horizontally extends to be continuous with a lever-mounting portion 8*a*. A portion of the upper surface of the wippen 20 rearward of the lever-mounting portion 8*a* is constructed substantially symmetrically to the above front-side portion of the upper surface. The lever-mounting portion 8*a* has bifurcated portions each of which has a lower end formed with a lightening hole 30 (lightening portion) (only one of which is shown) that extends therethrough in the left-right direction, for reducing the weight of the wippen 20, in place of the upper recess 13 described above.

A heel section 22, as far as its profile is concerned, is surrounded by a front surface 22*a* extending substantially perpendicularly downward from the rear end of the front part 6, a front inclined surface 22*b* shortly extending obliquely downward and backward from a lower end of the front surface 22*a*, a bottom surface 22*c* horizontally extending from a lower end of the front inclined surface 22*b* via a stepped part, a rear inclined surface 22*d* shortly extending obliquely upward and backward from a rear end of the bottom surface 22*c* via a stepped part, and a rear surface 22*e* extending obliquely upward from a rear end of the rear inclined surface 22*d* in a slightly curved manner. By forming the front and rear inclined surfaces 22*b* and 22*d*, compared with a case where the bottom surface 22*c* is at right angles to the front surface 22*a* and the rear surface 22*e* without provision of these surfaces 22*b* and 22*d*, the height of the wippen 20 is progressively reduced at the front and rear inclined surfaces 22*b* and 22*d*, toward the front and rear sides, respectively, whereby the weight of the wippen 20 is more reduced accordingly.

In the opposite side surfaces of the main body 2 and the heel section 22, there are formed recesses 35 (only one of which is shown) such that each of them extends from a rear part 7 into the whole of the heel section 22, leaving outer peripheral portions having a predetermine width. The depth of each recess 35 is set to the same value as that of the above-mentioned central recesses 14 and the like according to the first embodiment.

Further, the recess 35 has a total of nine lightening holes 31 (lightening portions) formed therethrough in the left-right direction in an area ranging from a central part 8 to the heel section 22. More specifically, out of the nine lightening holes 31, two are formed in an upper portion of the recess 35 and below the lever-mounting portion 8*a*, four are formed in a central portion of the recess 35, and three are formed in a lower portion of the recess 35, such that ones in each portion are arranged at equal intervals in the front-rear direction, and the nine lightening holes 31 as a whole are in staggered arrangement.

As described above, the recesses 35 have a depth set to the same value as that of the central recesses 14 and the like according to the first embodiment, and are formed in an area ranging from the rear part 7 to the whole heel section 22, and furthermore they have the lightening holes 30 and 31 formed therein. Therefore, it is possible to reduce the weight of the wippen 20 to a maximum allowable extent.

Figure 7:
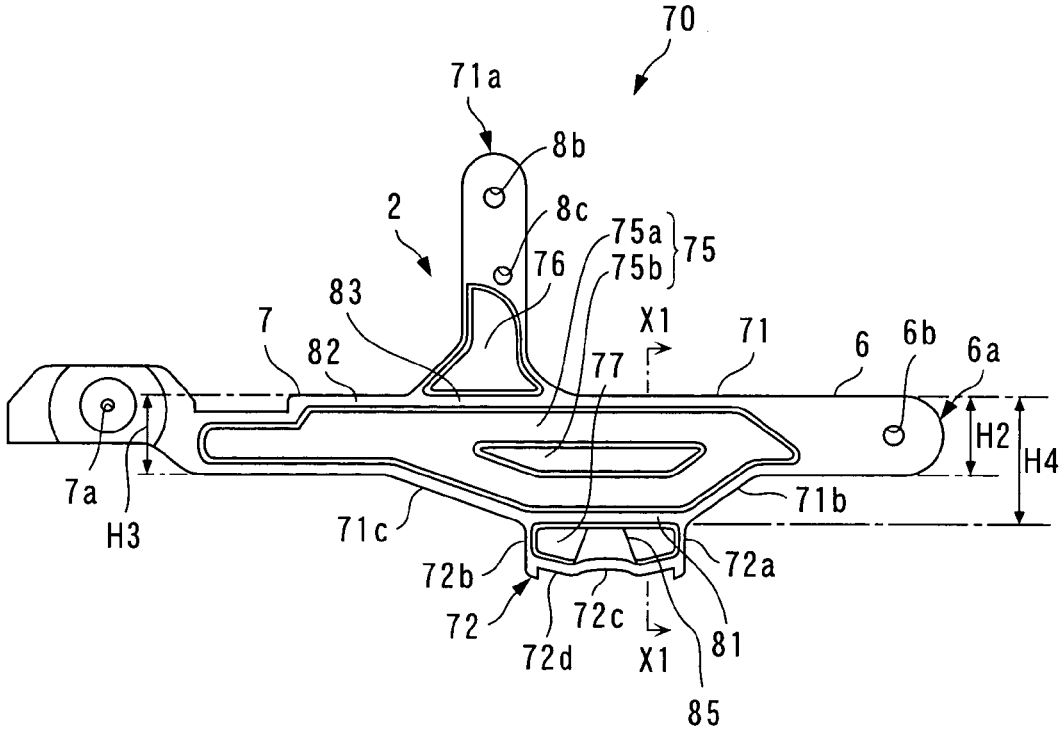
FIG. 7 is a side view of a wippen according to a third embodiment of the invention.
Figure 8:
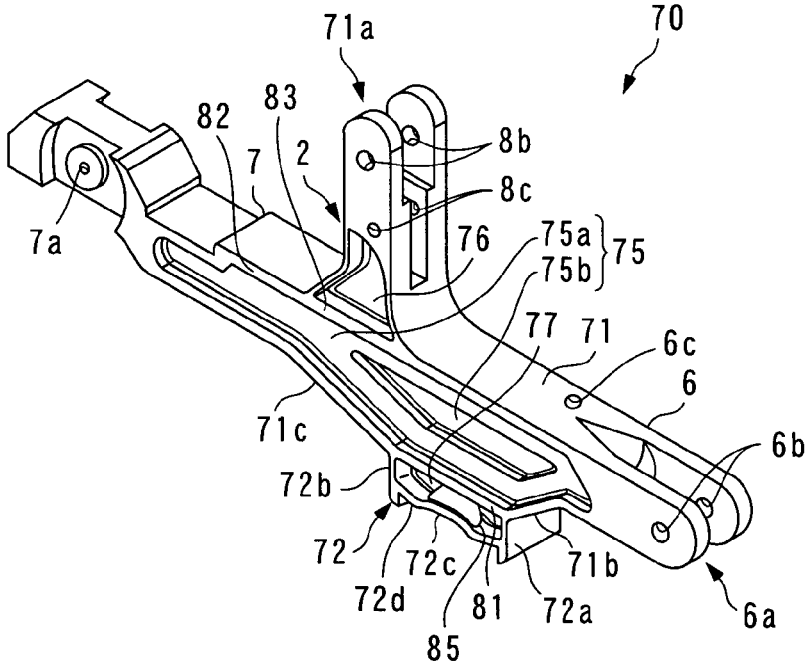
FIG. 8 is a perspective view of the FIG. 7 wippen.

FIG. 7 and FIG. 8 shows a wippen 70 (action part) according to a third embodiment of the invention. In these figures, component elements identical to those of the wippen 1 according to the first embodiment are designated by identical reference numerals. The wippen 70 according to the present embodiment is distinguished from the first embodiment mainly in the shape of sides, and the construction of each recess 35 (lightening portion) for reducing the weight of the wippen 70.

A lever-mounting portion 71*a* is distinguished from the first embodiment only in shapes of a front surface and a rear surface thereof. More specifically, the front surface is continuous with an upper surface of a central part 71 via an inwardly curved surface, and the rear surface is continuous with the upper surface of the central part 71 via an inclined surface linearly extending backward.

The central part 71 has a predetermined height H4 (vertical length) larger than the heights of a front part 6 and a rear part 7, and protrudes downwardly. A heel section 72, as far as its profile is concerned, is surrounded by a front surface 72*a* and a rear surface 72*b*, both of which extend substantially linearly in the vertical direction, and a bottom surface 72*d* extending in the front-rear direction between lower ends of the front surface 72*a* and the rear surface 72*b*. The bottom surface 72*d* of the heel section 72 includes a capstan screw-abutting portion 72*c* having a central portion thereof slightly recessed, and is formed symmetrically with respect to the center of the capstan screw-abutting portion 72*c*. The bottom surface 72*d* includes respective portions obliquely extending from locations slightly above the lower ends of the front surface 72*a* and the rear surface 72*b* to the capstan screw-abutting portion 72*c*.

Further, the front surface 72*a* of the heel section 72 is continuous with a lower surface of the front part 6 via a front inclined surface 71*b* (transition portion) extending linearly. The rear surface 72*b* of the heel section 72 is continuous with a lower surface of the rear part 7 via a rear inclined surface 71*c* (transition portion) extending linearly. A boundary portion between the heel section 72 and the central part 71 is formed with a lower inner rib 81 in a manner horizontally extending in the front-rear direction. The lower inner rib 81 has a front end and a rear end continuous with the front inclined surface 71*b* and the rear inclined surface 71*c*, respectively.

Further, recesses in each side surface of the wippen 70 are comprised of a main body recess 75, a lever recess 76, and a heel recess 77. The main body recess 75 extends in the front-rear direction over a long distance between a rear-side portion of the front part 6 and an intermediate portion of the rear part 7. Further, the main body recess 75 has a shape surrounded by an outer rib 82 extending along the upper and lower surfaces of the main body, and the lower inner rib 81, and is formed by an outer recess 75*a* and a central recess 75*b*.

Figure 9:
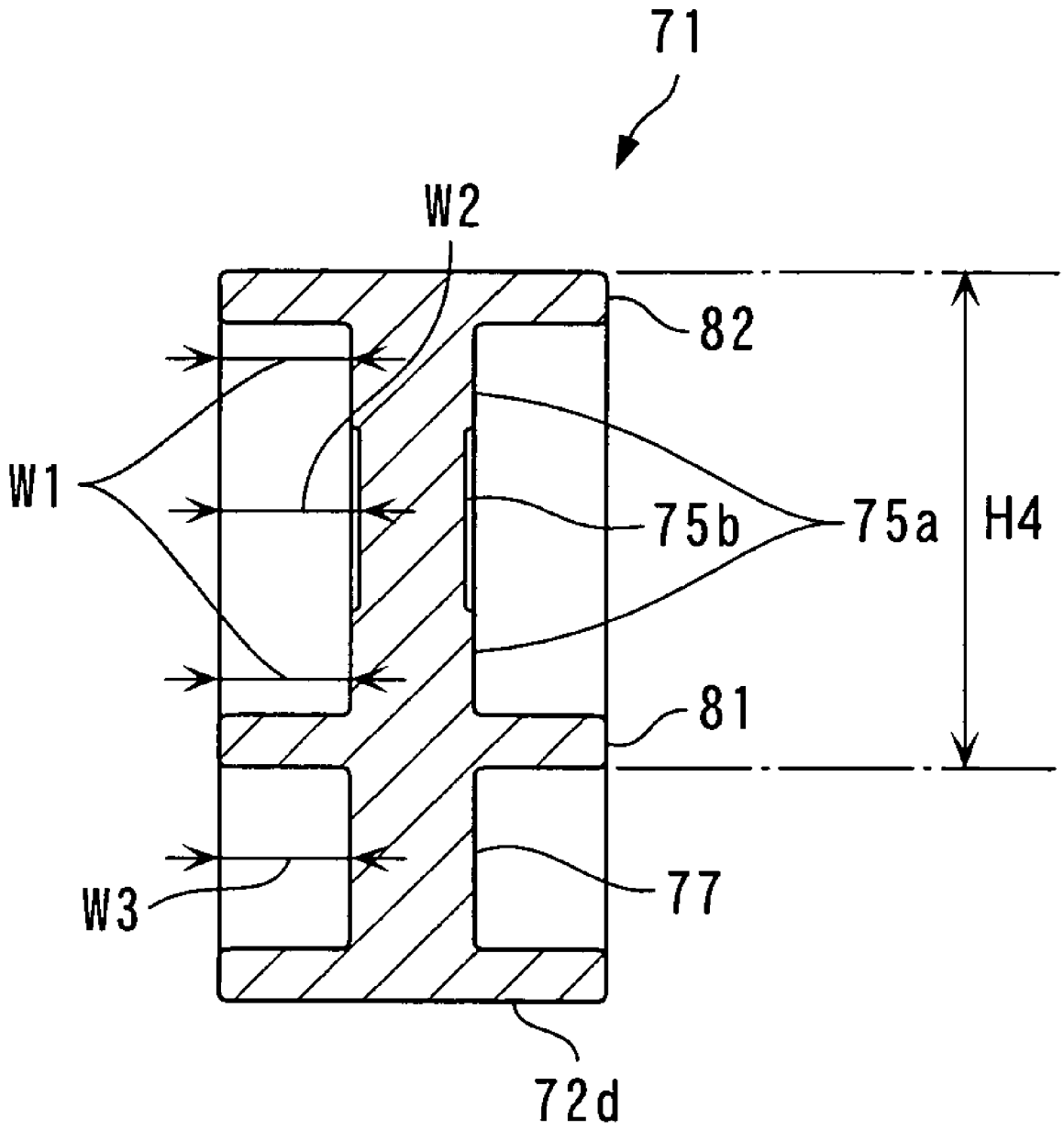
FIG. 9 is a cross-sectional view of the wippen taken on line X1—X1 of FIG. 7.

The central recess 75*b* extends in the front-rear direction and is formed to have a shape of an up-side down trapezoid in which an upper base is longer than a lower base. The upper base and the lower base extend in parallel with the upper surface of the central part 71, and the other two oblique lines extend in parallel with the front inclined surface 71*b* and the rear inclined surface 71*c*, respectively. The central recess 75*b* has a shape as described above, and a portion of the main body recess 75, located outside the central recess 75*b*, forms the outer recess 75*a*. As shown in FIG. 9, the depth of the outer recess 75*a* is set to a first predetermined value W1 (e.g. 3.3 mm), while the depth of the central recess 75*b* is set to a second predetermined value W2 (e.g. 3.4 mm) larger than the first predetermined value W1.

The lever recess 76 is disposed in a lower portion of the lever-mounting portion 71*a* and has a predetermined shape. More specifically, an upper inner rib 83 is formed on a boundary portion between the main body recess 75 and the lever-mounting portion 71*a* in a manner horizontally extending in the front-rear direction, and the lever recess 76 is formed in all over an area between the upper inner rib 83 and a spring-mounting hole 8*c* of the lever-mounting portion 71*a*. An upper portion of the lever recess 76 has a contour bent in an upwardly curved manner to extend rearward. Further, respective ribs arranged on a front surface and a rear surface of the lever-mounting portion 71*a* have thicknesses slightly thinner than the upper inner rib 83. The depth of the lever recess 76 is set to a third predetermined value W3 equal to that of the heel recess 77, referred to hereinafter.

The heel recess 77 has a shape surrounded by the lower inner rib 81, and the front surface 72*a*, bottom surface 72*d*, and rear surface 72*b* of the heel section 72. As shown in FIG. 9, the depth of the heel recess 77 is set to the third predetermined value W3 (e.g. 3.3 mm).

Further, similarly to the first embodiment, the opposite heel recesses 77 has an increased-thickness reinforcing portion 85 for reinforcing the rigidity of the heel section 72, formed at locations exactly above a capstan screw-abutting portion 72*c*. The increased-thickness reinforcing portion 85 has a generally conical shape, and is provided vertically from top to bottom of the heel recess 77. The increased-thickness reinforcing portion 85 protrudes laterally in the left and right directions such that most protruded portions thereof are flush with opposite side surfaces of the heel section 3.

As described hereinabove, not only the main body recesses 75 are formed in large areas in opposite side surfaces of the main body 2, but also the heel recesses 77 and the lever recess 76 are formed in the heel section 72 and the lever-mounting portion 71*a*, respectively, so that it is possible to sufficiently reduce the weight of the wippen 70. Further, similarly to the first embodiment, since the H4 of the central part 71 is larger than the heights of the front part 6 and the rear part 7, the rigidity of the central part 71 is enhanced. Further, the rigidity of the section 72 is increased by the increased-thickness reinforcing portion 85 of the heel section 72. As described above, when the heel section 72 is pushed up by the key 52, the wippen 70 is pivotally moved about the horizontal axis extending through a supported hole 7*a*. This causes a bending load to be applied to the wippen 70 to generate a bending stress. In general, the bending stress is smaller in a central portion of the wippen 70, and larger in an outer portion thereof. According to the present embodiment, however, the depth of the main body recess 75 is set to a larger value for the central recess 75*b*, and a smaller value for the outer recess 75*a*, whereby it is possible to obtain just an appropriately high rigidity in a manner matching distribution of the bending stress. From this construction, it is possible to obtain the high rigidity of the wippen 70 and the reduced weight thereof at the same time in a properly-balanced manner.

Further, since the outer recess 75*a* and central recess 75*b* of the main body recess 75 are formed in a stepped arrangement, a mold for molding the wippen 70 can be produced more easily than a mold for molding a wippen having a recess whose depth continuously changes.

FIGS. 10A to FIG. 12 show a wippen 90 (action part) according to a fourth embodiment of the invention. In these figures, component elements identical to those of the wippen 1 according to the first embodiment are designated by identical reference numerals. The wippen 90 according to the present embodiment is distinguished from the first embodiment mainly in the shape of sides thereof, and the constructions of recesses for reducing the weight of the wippen 90.

Differently from the first embodiment, a lower end of a lever-mounting portion 91*a* is not bifurcated, but the side thereof has a substantially trapezoid-like shape. Further, the lower end of the lever-mounting portion 91*a* has a front surface and a rear surface bent in an inwardly curved manner to be continuous with a central part 91 and a rear part 92 of a main body 2, respectively.

Figure 10A:
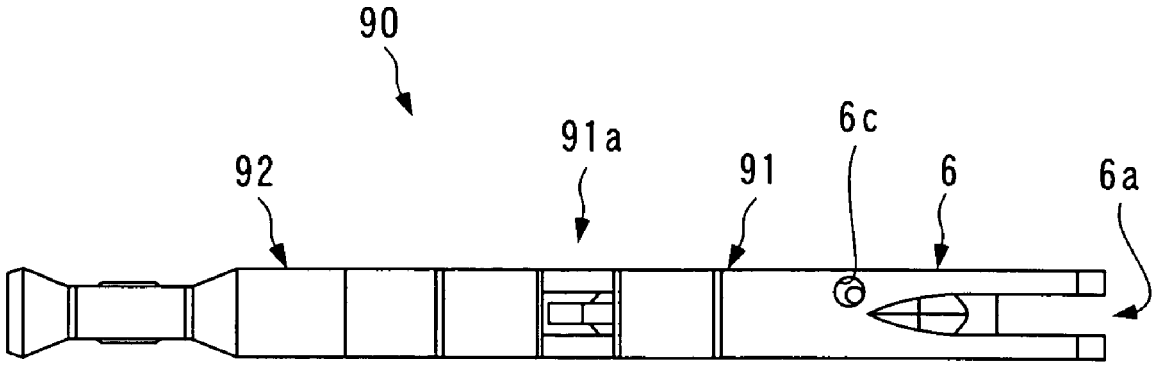
FIG. 10A is a plan view of a wippen according to a fourth embodiment of the invention.
Figure 10B:
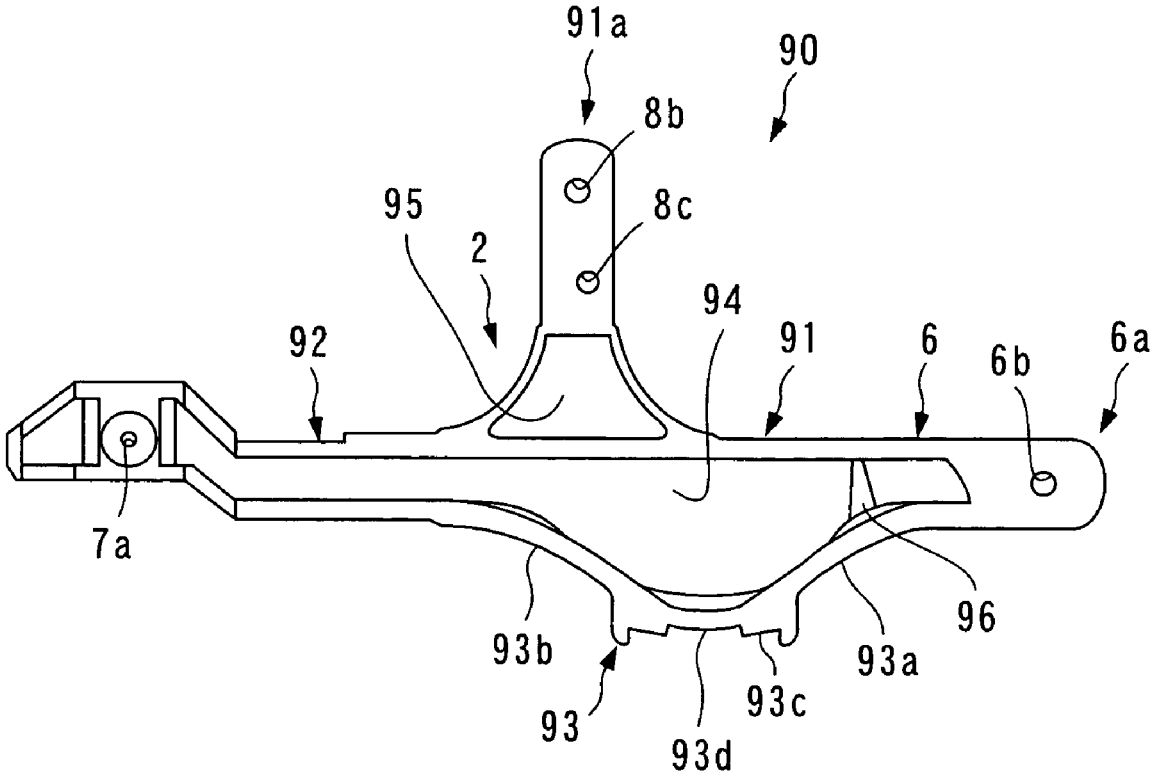
FIG. 10B is a left side view of the wippen according to the fourth embodiment of the invention.

A portion of the rear part 92, formed with a supported hole 7*a*, is made thinner than the other portions of the wippen 90 except for recesses, referred to hereinafter, and neighboring portions forward and rearward thereof are formed to have a shape tapered toward the first-mentioned portion of the rear part 92 (see FIG. 10A).

A heel section 93, as far as a profile thereof is concerned, is surrounded by a front surface 93*a*, a rear surface 93*b*, and a bottom surface 93*c* extending in the front-rear direction between lower ends of the front and rear surfaces 93*a*, 93*b*. The front surface 93*a* of the heel section 93 extends obliquely downward and backward from a rear end of the front part 96 of the main body 2 in an inwardly slightly curved manner, and then shortly approximately linearly extends downward. The rear surface 93*b* of the heel section 93 is formed almost symmetrically to the front surface 93*a*. More specifically, the rear surface 93*b* extends obliquely downward and forward from a front end of the rear part 92 in an inwardly slightly curved manner, and then shortly approximately linearly extends downward. The bottom surface 93*c* of the heel section 93 is formed symmetrically in the front-rear direction with respect to a capstan screw-abutting portion 93*d* having a center thereof slightly recessed, and obliquely extends from locations slightly above the lower ends of the front surface 93*a* and the rear surface 93*b* to the center of the heel section 93.

Recesses (lightening portions) in each side surface of the wippen 90 are formed by a main body recess 94 and a lever recess 95. The main body recess 94 has a predetermined depth (e.g. 3.8 mm), and is continuously formed in an area from a rear-side portion of the front part 6 to all of the central part 91, the heel section 93, and the rear part 92, except for the portion of the rear part 92 formed with the supported hole 7*a*, leaving outer peripheral portions having a predetermine width from the outer surfaces of the main body 2 and the heel section 93.

Figure 11:
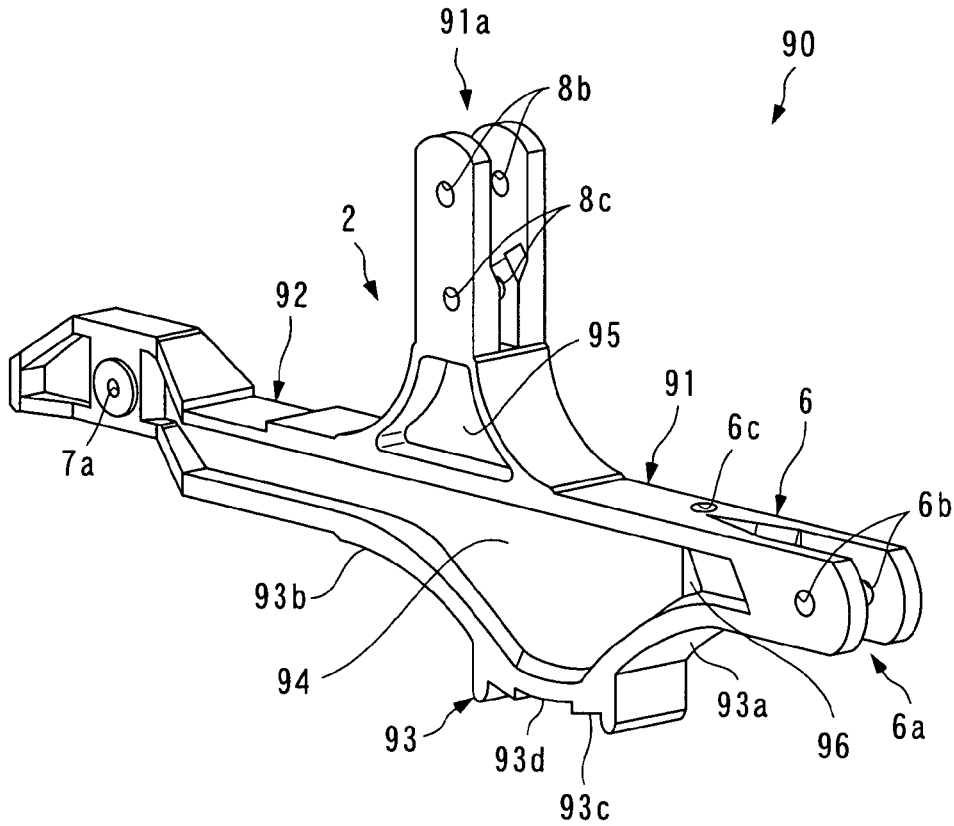
FIG. 11 is a perspective view of the wippen shown in FIGS. 10A and 10B.
Figure 12:
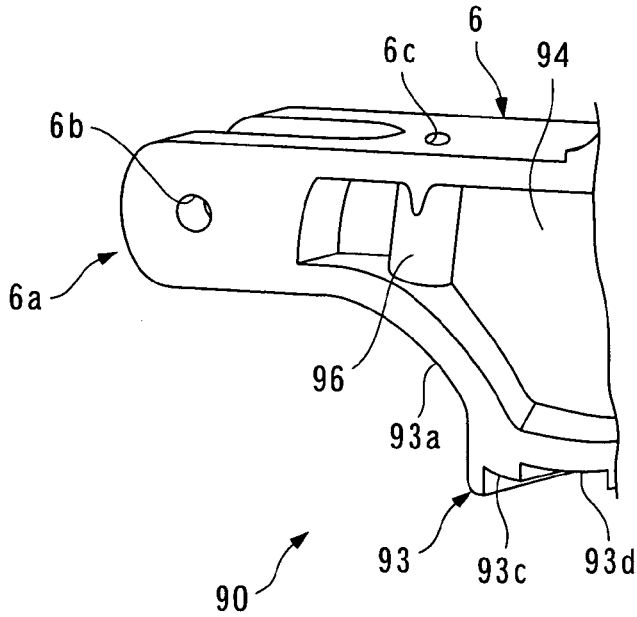
FIG. 12 is a diagram showing a part of a right-side surface of the wippen shown in FIGS. 10A and 10B.

Further, a reinforcing portion 96 is formed such that it extends through front end portions of the main body recesses 94, for reinforcing the rigidity of a part corresponding to the spoon-mounting hole 6*c*, described above. The reinforcing portion 96 has a generally cylindrical shape, and extends vertically, while protruding laterally in the left and right directions. Further, as shown in FIGS. 11 and 12, to cause the spoon-mounting hole 6*c* to extend along a center of the reinforcing portion 96, the reinforcing portion 96 is formed such that it extends obliquely downward from a location toward the right side and close to the upper surface of the front part 6, as viewed from the player, toward the player side to a location toward the left side. As a result, the reinforcing portion 96 more protrudes on the right side than on the left side, and the most protruded portion thereof is flush with the right-side surface of the front part 6.

The lever recess 95 is formed in a lower end of the lever-mounting portion 91*a*. The lever recess 95 has a generally trapezoid-like shape, which has sides extending along outer surfaces of the lever-mounting portion 91*a* in a manner spaced from the main body recess 94. The lever recess 95 has a fixed depth which is set to a predetermined value (e.g. 4.0 mm) slightly larger than that of the main body recess 94.

As described above, since the front surface 93*a* and the rear surface 93*b* of the heel section 93, continuous with the main body 2 extend in a curved manner, it is possible to enhance the rigidity of a boundary portion between the heel section 93 and the main body 2 as well as to prevent stress concentration at the boundary portion when a thrusting force of the key 52 acts thereon, and inconveniences caused by the stress concentration. Further, not only the main body recess 94 is formed in a manner continuously extending over a wide range of the opposite side surfaces of the main body 2 and the heel section 93, but also the lever recess 95 is formed in the lever-mounting portion 91*a*, so that it is possible to sufficiently reduce the weight of the wippen 90.

It should be noted that the present invention is not necessarily limited to the embodiments described above, but can be practiced in various forms. For example, although in the above embodiments, the present invention is applied to a wippen for an action of a grand piano, this is not limitative, but the present invention can be applied to action parts other than the wippen of a grand piano, and action parts of an upright piano, including a wippen. In this case, by applying the present invention to a part involved in transition of key depression energy to a hammer, such as a jack, out of the action parts other than the wippen, it is possible to obtain the effects provided by the present invention in an advantageous fashion. Further, the present invention may be applied to the repetition lever 53 having a lever skin 59 (see FIG. 3) bonded to a front end portion thereof. In this case, the repetition lever 53 is formed by an ABS resin molded article, whereby the lever skin 59 can be easily bonded to the repetition lever 53 by using an adhesive, thereby making it possible to enhance the ease of assembly of the action 51.

Although the recesses 11 to 14, and the like are formed in the main body 2 and the heel section 3, 22, 72 or 93 as recesses for reducing the weight of the wippen, they may be formed in one of the main body and the heel section. Further, the recesses 11 to 14, and the like may have any shapes and sizes, so long as they can attain the goal of the present invention, i.e. reduction of the weight and provision of high rigidity, at the same time.

Further, although the upper surfaces of the transition portions 8*e* and 8*f* are caused to extend in a curved manner, they may be caused to extend obliquely linearly. Further, although the transition portions 8*e* and 8*f* are arranged at the boundary portions between the central part 8, and the front part 6 and the rear part 7, this is not limitative, but the transition portion may be provided at only one of the boundaries. Further, the shape and size of the increased-thickness reinforcing portion 15 are not limited to those described in the embodiment, but the increased-thickness reinforcing portion 15 may have any shape and size, so long as it can reinforce the rigidity of the heel section 3. Furthermore, although in the above embodiment, both of the front surface 93*a* and the rear surface 93*b* of the heel section 93 are caused to extend in a curved manner, this is not limitative, but only one of the surfaces may be caused to extend in a curved manner, or alternatively both of or one of the surfaces may be caused to extend obliquely linearly.

It is further understood by those skilled in the art that the foregoing are preferred embodiments of the invention, and that various changes and modifications may be made without departing from the spirit and scope thereof.

What is claimed is:

1. An action part for a piano, which is pivotally moved along with depression of a key to thereby transmit key depression energy generated by depression of the key, to a hammer, wherein the action part is a wippen pivotally moved by being pushed up by the key depressed, and is formed by a thermoplastic resin molded article that is molded by a long fiber process and contains long fibers for reinforcement, wherein the wippen comprises:

a main body that extends in a front-rear direction, and includes a front part, a rear part pivotally supported about a horizontal axis, and a central part located between said front part and said rear part, and having a vertical length larger than those of said front part and said rear part, a heel section for being pushed up by the key, said heel section protruding downward from said central part of said main body, and being continuous with said front part and said rear part of said main body via respective transition portions having obliquely linear or curved lower surfaces, and a recess formed in at least one of said main body and said heel section, for reducing a weight of the at least one of said main body and said heel section, and wherein said recess is continuously formed in said main body and said heel section.

2. An action part as claimed in claim 1, wherein the long fibers are carbon fibers.

3. An action part as claimed in claim 1, wherein the thermoplastic resin is an ABS resin.

4. An action part as claimed in claim 1, wherein at least one of said front part and said rear part of said main body is continuous with said central part of said main body via a transition portion having an obliquely linear or curved upper surface.

5. An action part as claimed in claim 1, wherein said heel section includes a increased-thickness reinforcing portion for reinforcing said heel section.

6. An action part for a piano, which is pivotally moved along with depression of a key to thereby transmit key depression, energy generated by depression of the key, to a hammer, wherein the action part is at least one of a wippen, a jack and a repetition lever, and is formed by a thermoplastic resin molded article that is molded by a long fiber process and contains long fibers for reinforcement, and wherein the long fiber process is one for obtaining a molded article by injection molding of a pellet that is coated with a thermoplastic resin and contains a fibrous reinforcing material containing fibers having a same length as a length of the pellet.

7. An action part as claimed in claim 6, wherein the long fibers are carbon fibers.

8. An action part as claimed in claim 6, wherein the action part includes a lightening portion for reducing a weight of the action part.

9. An action part as claimed in claim 6, wherein the thermoplastic resin is an ABS resin.

10. An action part as claimed in claim 6, wherein the action part is a wippen pivotally moved by being pushed up by the key depressed.

11. An action part as claimed in claim 10, wherein the wippen comprises:

a main body that extends in a front-rear direction, and includes a front part, a rear part pivotally supported about a horizontal axis, and a central part located between said front part and said rear part, and having a vertical length larger than those of said front part and said rear part, a heel section for being pushed up by the key, said heel section protruding downward from said central part of said main body, and being continuous with said front part and said rear part of said main body via respective transition portions having obliquely linear or curved lower surfaces, and a recess formed in at least one of said main body and said heel section, for reducing a weight of the at least one of said main body and said heel section.

12. An action part as claimed in claim 11, wherein at least one of said front part and said rear part of said main body is continuous with said central part of said main body via a transition portion having an obliquely linear or curved upper surface.

13. An action part as claimed in claim 11, wherein said heel section includes a increased-thickness reinforcing portion for reinforcing said heel section.

14. An action part as claimed in claim 10, wherein said wippen comprises:

a main body that extends in a front-rear direction, and is pivotally supported about a horizontal axis at a rear end thereof, a heel section that protrudes downward from said main body, and includes a front surface and a rear surface continuous with said main body, at least one of the front surface and the rear surface being formed to extend obliquely linearly or in a curved manner, and a recess that is formed in at least one of said main body and said heel section, for reducing a weight of the at least one of said main body and said heel section.

15. An action part as claimed in claim 11, wherein said recess is continuously formed in said main body and said heel section.

* * * * *